US005899255A

United States Patent [19]

Petracini et al.

[11] Patent Number: 5,899,255

[45] Date of Patent: May 4, 1999

[54] HANGER AND DRIVING ASSEMBLY FOR CLOTHES OR CURTAINS

[76] Inventors: Orlando Arquimedes Petracini; Carlos Salvador Curcio, both of 3515 Larrazabal Ave., 1439 Buenos Aires, Argentina

[21] Appl. No.: 08/768,982

[22] Filed: Dec. 18, 1996

[30] Foreign Application Priority Data

Dec. 19, 1995 [AR] Argentina ..... 334692

[51] Int. Cl.[6] ..... E05D 15/06; A47H 5/06

[52] U.S. Cl. ..... 160/343; 16/87.6 R

[58] Field of Search ..... 16/87.6 R; 160/343

[56] References Cited

U.S. PATENT DOCUMENTS

| | | | |
|---|---|---|---|
| 2,715,966 | 8/1955 | Tieck | 16/87.6 R |
| 3,208,507 | 9/1965 | Breen | 160/343 |
| 3,585,674 | 6/1971 | Golden | 16/87.6 R |
| 3,774,665 | 11/1973 | Bourne | 160/343 |
| 4,023,609 | 5/1977 | Rosenquist | 160/343 |

FOREIGN PATENT DOCUMENTS

| | | | |
|---|---|---|---|
| 109601 | 2/1940 | Australia | 160/343 |
| 1183633 | 7/1959 | France | 160/343 |
| 240747 | 6/1946 | Switzerland | 160/343 |

*Primary Examiner*—Chuck Y. Mah
*Assistant Examiner*—Donald M. Gurley
*Attorney, Agent, or Firm*—Blackwell Sanders Peper Martin

[57] ABSTRACT

A hanger and driving assembly for hanging clothes or curtains that has a simple and reliable driving mechanism involving an easy operation to close and open the curtain without the need of cords, the assembly having a rail fixed to a wall or a roof of a building, a rod extending inside and along the entire length of the rail, the rod having at least one helical thread length, at least one driven runner being slidably mounted on the rod, the runner comprising a threaded bore through which the rod passes whereby the threaded bore is engaged with the helical thread length of the rod so as to be moved along the rod when the rod is rotated, the runner having at least one pair of wheels rotatably mounted to rotate about an axis and along inner surfaces of the rail the runner having a horizontally projecting hanging arm passing through an elongated opening extending along the bottom or the front wall of the rail.

6 Claims, 2 Drawing Sheets

HANGER AND DRIVING ASSEMBLY FOR CLOTHES OR CURTAINS

BACKGROUND OF THE INVENTION

1. Field of the Invention

The present invention relates to a new hanging assembly for hanging clothes or curtains of the type comprising a rail for guiding a plurality of sliders or runners capable of closing and opening the curtain and, more particularly, the invention refers to a hanger and driving assembly for hanging a curtain and for closing and opening the curtain, the assembly being capable of being fixed either to a supporting horizontal surface, such as a roof, or to a vertical surface, such as a wall of a building.

To the purpose of the present specification the term curtain must be understood as comprising one or more lengths of clothes or hangings.

2. Description of the Prior Art

It is well known to provide hanger assemblies for clothes or curtains, having a square C-shaped rail defining an inner track along which a plurality of sliders run, the sliders being connected to the curtain so as close and open the curtain when running along the inner track or tracks of the rail. The rail generally has a square section with the opening part of the C-shape defining a slot or opening running all along a bottom side of the square section, that is looking towards the floor of the building the track along which the sliders run are defined at both sides of the slot. Each slider generally comprises a plastic body slidably fitted within the rail with a bottom surface in sliding contact with the tracks of the rail. Each slider also comprises a hanger element, such as a hook, downwardly projecting from the slider and passing outside the rail through the bottom slot of the rail, for fixing an upper edge of the curtain. Although this type of hanger assembly is widely used the same does not suitably operate as far as a friction resistance must be overcome between the slider and the track inner surface of the rail over which the slider slidably runs. This resistance is increased with the dirty, particularly room dust, collected within the rail, on the inner surfaces thereof.

To overcome the drawback related to the increased friction which frequently causes the system to be broken or the curtain dragged, other hanger systems incorporate wheels. In this type of hangers the runner includes two or four wheels rotating about respective horizontal axes and along horizontal tracks defined by inner surfaces at each side of a bottom slot of the rail. Like the slot of the type including sliders, this slot is for allowing a hanger element downwardly projecting from the runner to pass through the slot outside the rail for retaining a curtain.

The tracks for the rolling runners must be free of any irregularity or obstacles which, including dust, may cause the wheels to be taken off from or run off the tracks which, in turn, causes the runner to be blocked within the rail. This is because the wheels rest and run along the horizontal tracks under the load of the gravity plus the weight, some times very heavy, of the hangings.

In any of the above types of hanger systems, either with sliders or rolling runners, a driving mechanism is necessary to make the runners or sliders move along the inner tracks of the guiding rail. In most simple systems only one or two bars are provided for one length or two lengths of clothe respectively. The bar or bar are manually pulled on to open or close the curtain. The bar generally is fixed to a leading runner or slider while the remaining runners are fixed to the upper edge of the curtain in a uniform spaced array so as to move the curtain entirely when pulling only from the leading runner.

Another systems include a cord extending along the rail, fixed to the only one leading runner, if the curtain comprises only one length of cloth, or to the two runners moving in opposite directions, when the curtain comprises two lengths of cloth. The cord is also extended around one or two pulleys and two ends of the cord is accessible to the user to pull down from one end or from the other to respectively open or close the curtain. As stated above, when two lengths of cloth are provided the system comprises two driven leading runners moving in opposite directions towards to or away from a central section of the guiding rail.

In all the above hanger systems, however, the square C-shaped rail comprises two lateral walls, an upper wall and a bottom wall, the bottom wall including a slot running all along the length of the rail and the hanging member projecting from the slider or the runner is downwardly pending so as to extend outside the rail through the bottom slot, with the slot, or opening of the C-shaped section, formed in the bottom wall of the rail the rail must be fixed to a horizontal surface such as a roof, by engaging the upper wall of the rail against the roof and fixing the wall by screws, for example, passing through the upper wall and fixed in the roof. When the roof is not accessible to fix the rail the upper wall must be fixed against another horizontal surface provided to this purpose which implies to manufacture an additional supporting structure or to specially provide additional support members.

Also in most of the conventional hanger systems the hanging member projecting from the slider or the runner comprises generally a hook-shaped member capable of being fixed to the fabric of the curtain in several manners. In some cases the hook has a sharp end so as to pass the hook through the fabric by puncturing the fabric with the risk of damaging the curtain. In addition, since no predetermined point in the curtain are marked to insert the sharpen end of the hook is quite probable that all the hooks do not remain aligned and at the same distance from the curtain edge, this causing the curtain to be not uniformly retained. Other systems provide a plurality of rings stitched in the proximate of the upper edge of the curtain and spaced apart from each other uniformly all along the entire length of the curtain. Each ring is respectively hooked in each of the hooks of the runners these rings, however, are an obstacle when the curtain is removed from the hanger assembly and is washed in a washing machine because the cloth is damaged under the effect of the repetitive action of the rings over the fabric during the washing operation of the machine.

It would be therefore convenient to have a hanger and driving system which can be fixed onto a vertical wall, which can be easily and reliably operated to close and open the hangings, such as a curtain and which allows the hangings to be easily retained in the hanger system with retaining means by means of which the curtain can be easily removed from the hanger system and can be washed manually or in a washing machine without the risk for the curtain to be damaged by the retaining means.

SUMMARY OF THE INVENTION

It is therefore one object of the present invention to provide a hanger and driving assembly for hanging clothes or curtains that is simple and easy and reliable to operate to close and open the curtain.

It is still another object of the present invention to provide a hanger and driving assembly for hanging clothes or curtains that overcome the problems of the prior art related to the easy sliding or rolling of the sliders and runners respectively without the drawbacks of blocking and failures of these conventional runners and sliders.

It is a further object of the present invention to provide a hanger and driving assembly for hanging clothes or curtains that has a simple and reliable driving mechanism that involves an easy operation of the system to close and open the curtain either formed by one or more lengths of clothes, without the need of cords that can be entangled or can block the running or sliding of the runners or sliders respectively.

It is even another object of the present invention to provide a hanger and driving assembly for hanging clothes or curtains which assembly can be fixed to a vertical wall without the need of additional support members.

Briefly, it is another object of the invention to provide a hanger and driving assembly for clothes or curtains of the type having a rail member fixed to a wall or a roof of a building, the rail member having an upper wall, a bottom wall, a front wall and a rear wall, at least one rod extending inside and along the entire length of the rail member, the rod having at least one helical thread length, at least one driven runner being slidably mounted on the rod, the runner comprising a threaded bore through which the rod passes whereby the threaded bore is engaged with the helical thread length of the rod so as to be moved along the rod when the rod is rotated, the runner having a top face and a bottom face, a top wheel and a bottom wheel are respectively mounted on the top and bottom faces, each wheel being rotatably mounted to rotate about a respective vertical axis and along inner surfaces of the front and rear walls of the rail member, the runner having a laterally projecting hanging arm passing through an elongated opening running along the front face of the rail member.

The above and other objects features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
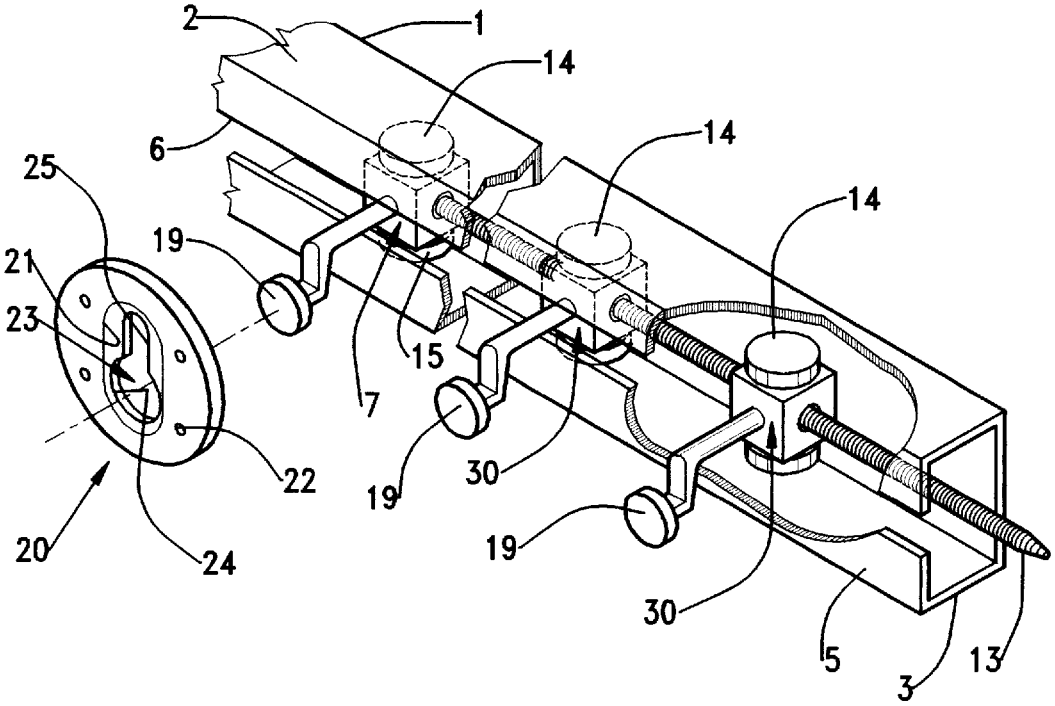
FIG. 1 shows a perspective, partially cross-sectional and partially exploded view of a hanger and driving assembly according to the invention.
Figure 2:
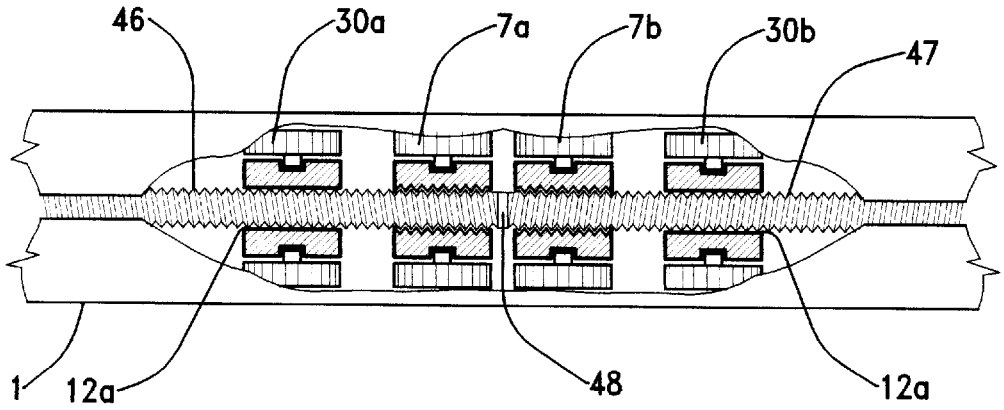
FIG. 2 shows a partial cross-section, front view of the hanger and driving assembly of FIG. 1.
Figure 3:
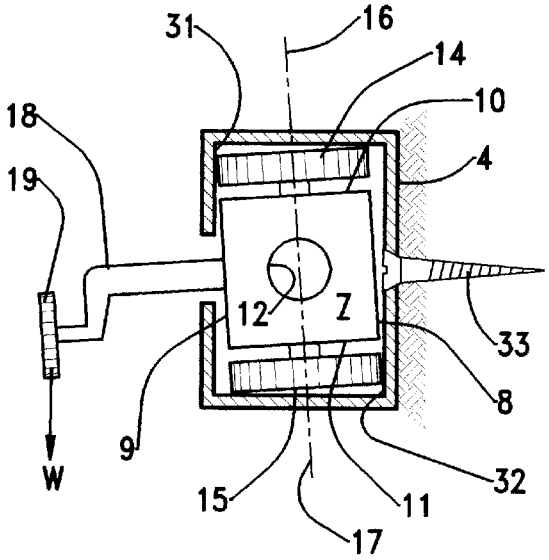
FIG. 3 shows a cross-sectional view of the assembly of FIG. 1.

Now referring in detail to the drawings it may be seen from FIG. 1–3 a first embodiment of the invention wherein the hanger and driving mechanism comprises a C-shaped tubular rail 1 having a top or upper wall 2, a bottom wall 3, a rear wall 4 and a front wall 5, the front wall including an elongated opening 6 forming a slot running all along the length of the rail. A plurality of runners are arranged inside rail 1, the runners comprising a driven leading runner 7 having a rear face 8, a front face 9, a top face 10 and a bottom face 11, a bore 12 passing through the runner body allows the runner to be slidably mounted around a threaded rod 13 extending all along the length of the rail. Runner 7 includes at least two wheels, namely a top wheel 14 and a bottom wheel 15 each wheel being rotatably mounted around the respective axes 16, 17. As it is clearly depicted in FIG. 3, each wheel 14, 15 has respective shafts 26, 27 freely accommodated within corresponding bores 28, 29. A laterally extended hanger arm 18 projects substantially horizontally from the runner and outside the rail through the slot 2, the arm ending in an outer enlarged end 19 capable of being removably retained within a socket member 20 which is fixed in the curtain by stitching, for example.

Socket member 20 comprises a disc having a recess 21 in a side which is to fixed against the fabric of a curtain, for example. A plurality of orifices 22 are provided to stitch the disc on an upper edge of the curtain. Recess 21 has an aperture 23 having an enlarged portion 24 and a restricted portion 25. End 19 is preferably a disc-shaped end to be connected to socket member 20 by inserting disc end 19 through the enlarged portion 24 and then sliding disc 19 into restricted portion 25 whereby, once into aperture portion 25, disc 19 is retained within portion 25 whit the weight of the curtain preventing the disc from being accidentally taken off from aperture 23 and socket member 20.

When the curtain must be removed for cleaning purposes, disc 19 is downwardly moved towards the enlarged portion of aperture 23 and the curtain is free to be inserted, for example, in a washing machine without the risks of damages like with the rings and other retaining members of the prior arts as far as socket member 20 is a flat disc shaped member capable of being closely retained against the fabric of the curtain without projections or portions extending out of the member.

In addition to the leading driven runner 7, a plurality of other free runners 30 are freely mounted within rail 1 and on rod 13. The difference between driven runner 7 and free runners 30 is that bore 12 of runners 30 is not threaded whereby runner 30 is not engaged with the thread of rod 13 and, therefore, runner 30 runs in a free manner along rod 3 only pulled by the leading runner 7 through the curtain connecting all the runners to each other.

Under the load exerted by the curtain weight, indicated by arrow W in FIG. 3, arm 18 tends to tilt runners 7, 30 in the way illustrated in FIG. 3. The tilt in this Figure is exaggerated to more clearly show how top wheel 14 rolls against an inner surface 31 of the front wall and bottom wheel 15 rolls against an inner surface 32 of the rear wall of the rail. Both surfaces 31, 32 define respective tracks for the wheels and prevent the runners from being blocked within the rail under the effect of any obstacle, such as dirty and the like, as long as this kind of obstacles do not remain in vertical tracks such as the ones defined by surfaces 31, 32. This particular and novel arrangement allows the hanger system to be fixed onto a vertical wall, by means of screws 33, for example, when no horizontal support surfaces are available.

Figure 4:
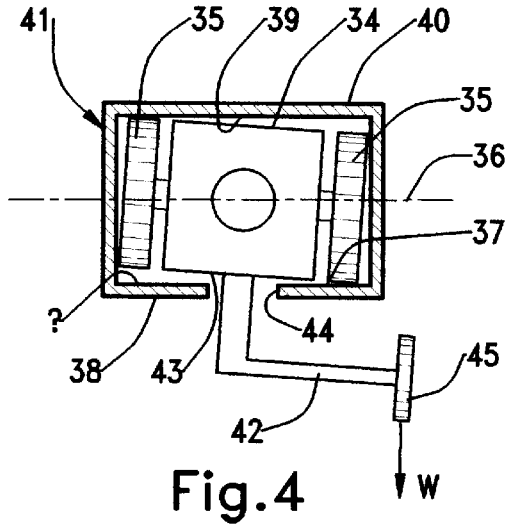
FIG. 4 shows a cross-sectional view of another embodiment of the assembly according to the invention.
Figure 5:
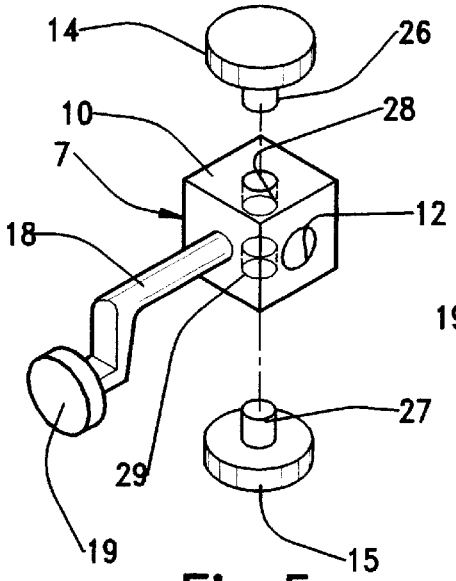
FIG. 5 shows an exploded view of a runner of the invention including one pair of wheels.

When a horizontal support surface is available, a screw (not shown) may be applied through top wall 2 of rail 1 to fix the rail to such a surface. Alternatively, another embodiment, shown in FIG. 4, may be provided wherein a runner 34, very similar to runners 7, 30, is provided with wheels 35 rotatably mounted around an axis 37. Because of the weight of the curtain, indicated also by reference number W like in FIG. 3, the hanging will tends to tilt runner 34 in the way shown in FIG. 4 whereby the wheels will roll along tracks defined by the inner surface 37 of a bottom wall 38 and inner surface 39 of a top wall 40 of a C-shaped rail 41. In this embodiment, the hanging arm comprises an arm 42 hanging from a bottom face 43 of runner 34 and laterally extended after passing through a bottom slot 44 in the bottom wall 38. An enlarged end 45 is also provided, like in the embodiment of FIGS. 1–3.

As it is shown in FIG. 2, rod 3 has two lengths of threads, namely threads 46, 47, inversely wound around the entire length of rod 3 and arranged at both sides of a central section 48. This two-threads arrangement are used when the curtain comprises two clothe length capable of being pulled to open or close relative to central section 48. With this arrangement two leading driven runners 7*a*, 7*b* are provided to be driven in opposite directions when rotating rod 3. The remaining runners comprise the free runners 30*a*, 30*b* the bores of which are not threaded as it is indicated by 12*a* and explained above when particular reference to runners 30 were made.

When rod 13 is rotated in a predetermined direction, let us say the clockwise direction, the threaded engagement between the threads of rod 3 and the threaded bores 12 of the runners will cause runners 7*a*, 7*b* to move to the left and to the right respectively (looking to FIG. 2) so as to pull from the curtain lengths to which the runners are fixed. In the way of moving towards their respective directions, runners 7*a*, 7*b* will push the closest free runner and thus all the free runners slidably mounted within rail 1 and on rod 3 so as to open the curtain relative the central section of the rod. When rotating the rod in the opposite direction, that is counterclockwise, runners 7*a*, 7*b* will be pulled towards each other so as to meet at the central section of the rod. In its moving way, runners 7 will pull from the respective curtain length to close them, which curtain will, in turn, carry the free runners along the rod.

Although it is not part of this invention, any conventional mechanism, mechanical or electrical, or a combination thereof, may be provided to rotate the rod in any desired direction as explained above. For example, rod 3 may be directly connected at one end thereof to an electrical motor that may me accommodated in any suitable support mounting on the wall. The rod can also be connected to a gear box which in turn will be connected to a downwardly extended actuating bar that is accessible to the user by means of a handle, for example, which is to be connected to the bar to cause the bar to rotate and transmit the rotation, through the gear box, to the threaded rod for actuating the hanger and driving assembly of the invention.

Figure 6:
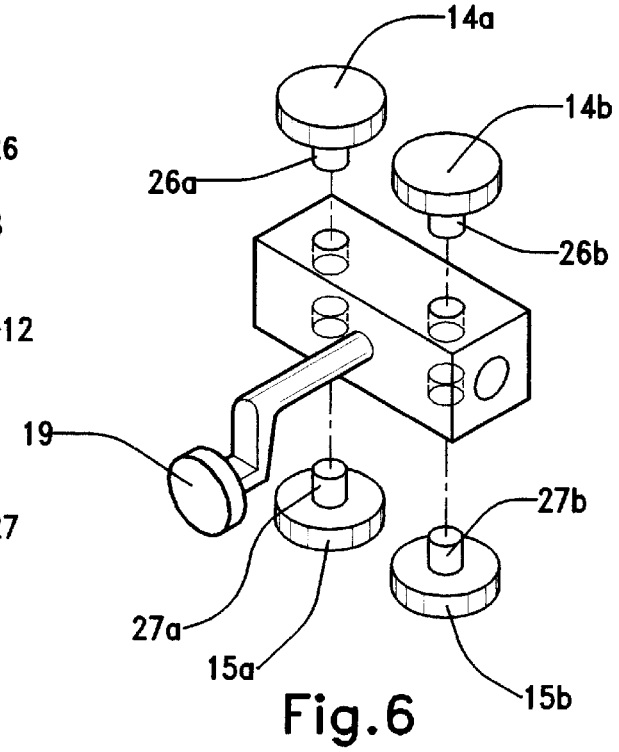
FIG. 6 shows an exploded view of another embodiment of the runner of the invention including two pairs of wheels.

FIG. 6 shows another alternative embodiment wherein runners 7, 30, indicated only by reference number 7 in this Figure, may be provided with two pairs of wheels 14*a*, 14*b* and 15*a*, 15*b* which, in turn, are respectively provided with their shafts 26*a*, 26*b* and 27*a*, 27*b*.

While preferred embodiments of the present invention have been illustrated and described, it will be obvious to those skilled in the art that various changes and modifications may be made therein without departing from the scope of the invention as defined in the appended claims.

We claim:

1. Hanger and driving assembly for clothes or curtains, of the type having a rail member fixed to a wall or a roof of a building, the rail member having an upper wall, a bottom wall, a front wall and a rear wall, at least one rod extending inside and along the entire length of the rail member, the rod having at least one helical thread length, a plurality of runners connected to the clothes or curtains comprising at least one driven runner and a plurality of free runners mounted on the rod, the driven runner comprising a threaded bore through which the rod passes whereby the threaded bore is engaged with the helical thread length of the rod so as to be moved along the rod when the rod is rotated, the runners having at least one pair of wheels rotatably mounted to rotate about an axis and along inner surfaces of the rail member, each runner having a horizontally projecting hanging arm passing through an elongated opening extending along the front wall of the rail member, each runner including a top face, a bottom face, a rear face and a front face and said at least one pair of wheels comprises a top wheel and a bottom wheel respectively mounted on the top and bottom faces of the runner, each wheel being rotatably mounted to rotate about a respective vertical axis and along inner surfaces of the front and rear walls of the rail member, the hanging arm laterally projecting from the runner and passing through the elongated opening running along the front wall of the rail member.

2. A hanger and driving assembly according to claim 1, wherein the rod comprises two inversely wound helical thread lengths at each side of a central section in the rod, at least two driven runners being provided, each runner being slidably mounted on, and threadably engaged with one of the thread lengths so as to move in opposite directions to close and open a curtain.

3. A hanger and driving assembly according to claim 1, wherein a pair of top wheels and a pair of bottom wheels are respectively mounted on the top and bottom faces of the runner.

4. A hanger and driving assembly according to claim 1, wherein the laterally projecting hanger arm comprises an elongated arm having an outer enlarged end capable of being removably retained within a socket member fixed to the curtain.

5. A hanger and driving assembly according to claim 4, wherein the outer enlarged end comprises a disc-shaped end.

6. A hanger and driving assembly according to claim 1, wherein the free runners include respective bores through which the rod freely passes so that the free runners can move along the rod under the pulling action of the driven runners through the clothe or curtain connected to the driven and to the free runners.

* * * * *